US008992727B2

(12) United States Patent
Laghi

(10) Patent No.: US 8,992,727 B2
(45) Date of Patent: Mar. 31, 2015

(54) DEVICE FOR REMOVING A PROTECTIVE FILM OFF A SHEET

(75) Inventor: Marco Laghi, Bagnacavallo (IT)

(73) Assignee: Everex S.r.l. (IT)

( * ) Notice: Subject to any disclaimer, the term of this patent is extended or adjusted under 35 U.S.C. 154(b) by 0 days.

(21) Appl. No.: 13/698,274

(22) PCT Filed: May 17, 2011

(86) PCT No.: PCT/IT2011/000155

§ 371 (c)(1),
(2), (4) Date: Nov. 15, 2012

(87) PCT Pub. No.: WO2011/148401

PCT Pub. Date: Dec. 1, 2011

(65) Prior Publication Data

US 2013/0056157 A1 Mar. 7, 2013

(30) Foreign Application Priority Data

May 25, 2010 (IT) ..... VE2010A0024

(51) Int. Cl.
*B32B 38/10* (2006.01)
*A63F 3/06* (2006.01)

(52) U.S. Cl.
CPC ..... *A63F 3/068* (2013.01)
USPC ..... 156/715; 156/760; 15/34; 15/77; 15/88.3; 15/93.1; 15/102; 15/308

(58) Field of Classification Search
None
See application file for complete search history.

(56) References Cited

U.S. PATENT DOCUMENTS

| | | | | |
|---|---|---|---|---|
| 2,264,885 | A * | 12/1941 | Mueller | 15/4 |
| 2,680,938 | A * | 6/1954 | Peterson | 451/67 |
| 2,781,535 | A * | 2/1957 | Phillips et al. | 15/77 |
| 3,440,675 | A | 4/1969 | Yeaman et al. | |
| 4,148,576 | A * | 4/1979 | Martino | 396/614 |
| 4,165,251 | A * | 8/1979 | Matsumoto et al. | 156/760 |
| 4,741,783 | A * | 5/1988 | Daunheimer et al. | 134/15 |
| 4,765,842 | A | 8/1988 | Sanders et al. | |
| 5,355,543 | A | 10/1994 | Cameron et al. | |
| 5,402,549 | A | 4/1995 | Forrest | |
| 5,417,424 | A | 5/1995 | Snowden et al. | |
| 5,907,882 | A | 6/1999 | Tyree | |

(Continued)

FOREIGN PATENT DOCUMENTS

| | | |
|---|---|---|
| EP | 0824944 | 2/1998 |
| FR | 2756496 | 6/1998 |

(Continued)

OTHER PUBLICATIONS

PCT International Search Report mailed on Sep. 28, 2011 for PCT/IB2011/001074 filed on May 18, 2011 in the name of Rolando Wyss.

(Continued)

*Primary Examiner* — Philip Tucker
*Assistant Examiner* — Nickolas Harm
(74) *Attorney, Agent, or Firm* — Steinfl & Bruno LLP

(57) ABSTRACT

A device for removing a protective film off a sheet such as tickets or the like is described. The device has at least one removal or scraping roll of the protective film and at least one drawing or pulling roll of the sheet opposite the scraping roll and between which the sheet passes. The device also has a base and a roll unit mobile or removable with respect to the base and including the scraping roll and the drawing roll.

7 Claims, 7 Drawing Sheets

(56) References Cited

U.S. PATENT DOCUMENTS

| | | | | |
|---|---|---|---|---|
| 6,076,584 | A * | 6/2000 | Yamamoto et al. | 156/760 |
| 6,155,491 | A | 12/2000 | Dueker et al. | |
| 6,243,903 | B1 * | 6/2001 | Taniguchi | 15/77 |
| 6,349,756 | B1 * | 2/2002 | Brough et al. | 156/767 |
| 7,311,599 | B2 | 12/2007 | Knapp | |
| 7,624,471 | B2 * | 12/2009 | Bae | 15/303 |
| 8,192,268 | B1 | 6/2012 | Karpe | |
| 2004/0162131 | A1 | 8/2004 | Shuster | |
| 2007/0037499 | A1 | 2/2007 | Burbridge | |

FOREIGN PATENT DOCUMENTS

| | | |
|---|---|---|
| WO | 2006/116501 | 11/2006 |
| WO | 2010/150295 | 12/2010 |

OTHER PUBLICATIONS

PCT Written Opinion mailed on Sep. 28, 2011 for PCT/IB2011/001074 filed on May 18, 2011 in the name of Rolando Wyss.

PCT Written Opinion mailed on Jul. 17, 2011 for PCT/IT2011/000155 filed on May 17, 2011 in the name of Brain Provider S.R.L.

PCT International Search Report mailed on Jul. 17, 2011 for PCT/IT2011/000155 filed on May 17, 2011 in the name of Brain Provider S.R.L.

Non-Final Office Action mailed on May 13, 2013 for U.S. Appl. No. 13/698,275, filed Nov. 15, 2012 in the name of Rolando Wyss.

Non-Final Office Action mailed on Jan. 2, 2014 for U.S. Appl. No. 13/698,275, filed Nov. 15, 2012 in the name of Rolando Wyss.

* cited by examiner

DEVICE FOR REMOVING A PROTECTIVE FILM OFF A SHEET

CROSS REFERENCE TO RELATED APPLICATIONS

The present application is the US national stage entry of International Application PCT/IT2011/000155 filed on May 17, 2011, which in turn claims priority to Italian Application VE2010A000024, filed on May 25, 2010. The present application may be related to International Application PCT/IB2011/001074 filed on May 18, 2011, the U.S. National Stage of which was entered on even date herewith under U.S. Ser. No. 13/698,275.

The present invention relates to a device for removing a protective film off a sheet such as scratch tickets or the like.

In the following, for only illustrative purposes, we will refer to the tickets of the above mentioned kind, but without considering this as a limitation of the scope of the invention.

As known, after buying the tickets such as scratch tickets, it is necessary to remove the film which partially covers them to see if the ticket is a winning one or not.

This operation can be done manually, but to quickly remove the protective film or paint, devices comprising a removal or scraping roll opposite to a drawing or pulling roll, both motorized, are used.

The scraping roll; appropriately corrugated, has the specific aim of removing the film, while the drawing roll has the function, together with the scraping roll, to draw the ticket so that the whole ticket passes between the scraping and drawing. roll.

Although these devices have undoubted advantages with respect to the manual scraping, however, they have several drawbacks.

In fact, it has to be considered that during the operation, the device may jam because for example the ticket gets stuck or does not flow in the right direction. Or else, the device may even break down. Anyway, it requires a standard and regular maintenance considering the remarkable stresses to which it is subjected.

In particular, in case of jamming, it is difficult to extract the ticket and, anyway, this operation requires time and energy. Sometimes, although the ticket is strongly pulled, it is impossible to extract it, so it is necessary to dismantle the device, to remove the cause of the jamming and, finally, it is necessary to reassemble the device performing the previous operations in a reverse order.

These operations are particularly long and laborious, and also require tools that are not always available, thus further complicating the situation.

The operation for reactivating the functionality of the device is time consuming. Moreover, it has to be considered the time when the machine is not functioning, i.e. when the device is completely inactive during the operation of the intervention with the consequent economic loss.

In addition, the device may break down, so the repair period is very time consuming and unacceptable, both because the repair operation is more complex, and because it could be necessary to require the intervention of specialized technicians who have to repair the failure.

The overall time for repair, also considering the waiting time for the skilled technicians, increases remarkably thus causing a huge economic loss.

Finally, it is necessary to provide maintenance operations which must be carried out regularly so as to maintain the device efficiently. Although these operations are planned, they also require that the machine has to be stopped with all the above mentioned disadvantages.

The aim of the invention is therefore to make a device in order to obviate all the above cited disadvantages and, in particular, a device which first of all allows to quickly remove the cause of the jam without using tools and without excessive efforts.

Furthermore, the repair and maintenance operations of the device must be fast and simple.

These aims are achieved by a device of the initially described kind, namely a device for removing a protective film off a sheet such as tickets or the like, comprising at least one removal or scraping roll of said protective film and at least one drawing or pulling roll of said sheet opposite to said at least one scraping roll and between which said sheet passes, characterized in that said device comprises a base and a roll unit including said at least one scraping roll and said at least one drawing roll, said roll unit being mobile or removable with respect to said base and able to take at least two positions, a first operative position wherein said roll unit is inserted or mounted in said base and a second inoperative position wherein said roll unit is displaced or removed from said base.

In case of jamming, to restore the operativeness of the device, it is sufficient to displace or remove the roll unit from its base to have access to the working area and, then, easily remove the ticket without any effort, thus eliminating the cause of the jamming and, then, to reinsert or reassemble the roll unit into the original position. Moreover, this operation does not require the use of tools and it is an extremely fast and simple operation.

Preferably, said roll unit comprises a first support and a second support spaced apart from each other and between which said at least one scraping roll and said at least one drawing roll extend, said first and second support having guiding profile and said base having two recesses having profiles corresponding to the guiding profiles of said first and second support, so that said first and second support may be inserted in said corresponding recesses of the base, thus making the roll unit removable with respect to said base.

So, even in case of failure, the operation occurs very simply and quickly. In fact, all that you need is a spare roll unit so that in case of failure of the rolls, which form the most critical mechanical part, it is sufficient to remove the roll unit and replace it with a new and working one.

It is evident that all the normal maintenance or cleaning operations of the device are very easy.

These and other advantages of the present invention will be more evident from the following detailed description of one of its embodiments given merely by way of example with no limitation and which refer to the following drawings wherein:

FIGS. 1 and 2 show a device 10 for removing a protective film off a sheet such as a ticket (for example a scratch ticket), a coupon, a card, or others.

The device 10 comprises a base 20, a removable roll unit 70 and a movable upper portion 51.

Figure 3:
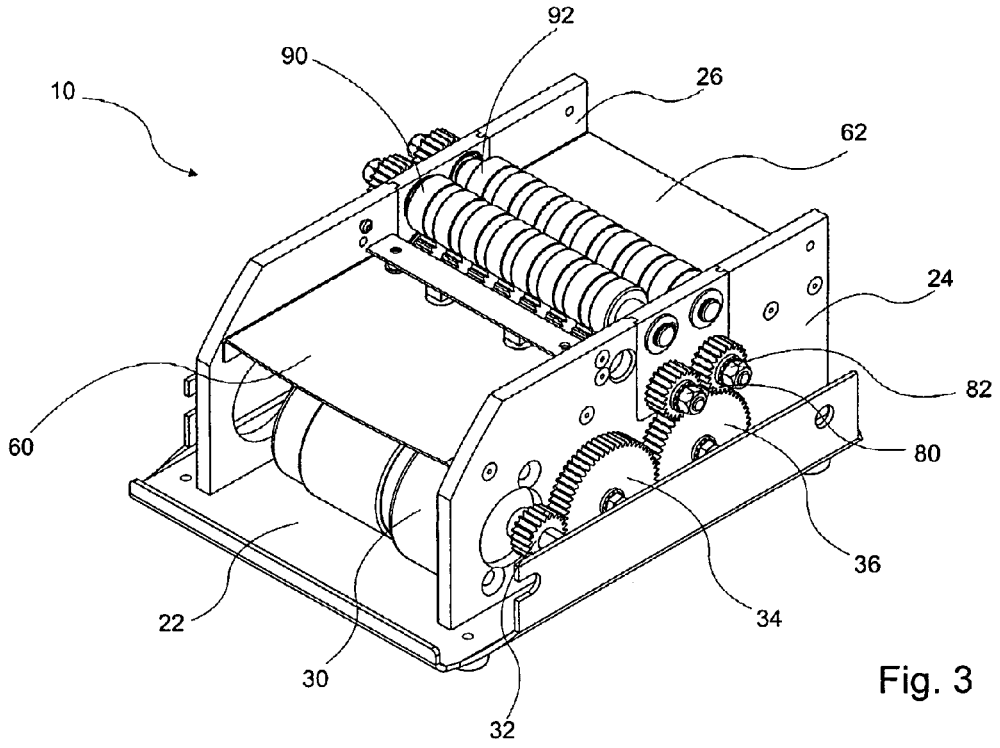
FIG. 3 is a perspective view of the device of FIGS. 1 and 2 where the upper mobile portion has been removed.

The base 20, as better illustrated in FIG. 3, comprises a lower base plate 22 from which a first and a second vertical wall 24,26 parallel and opposite to each other extends vertically.

A first electric motor 30 is mounted between the two walls 24,26 on the entry side 12 of the ticket, and it is coupled to a toothed wheel 32 mounted outside the first vertical wall 24. The first toothed wheel 32 meshes with a second toothed wheel 34 which in turn meshes with a third toothed wheel 36.

The electric motor 30 and the toothed wheels 32,34,36 form a first motorization for rotating the scraping rolls of the roll unit 70 which will be described below.

Figure 1:
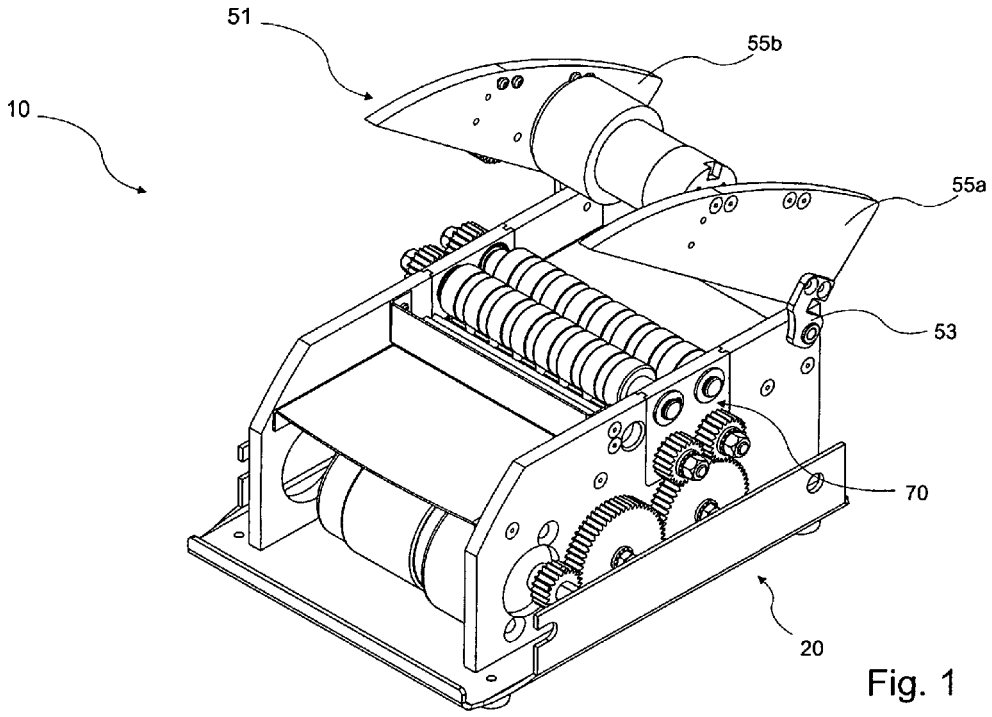
FIGS. 1 and 2 are two perspective views of a device according to the present invention represented in two different positions.
Figure 2:
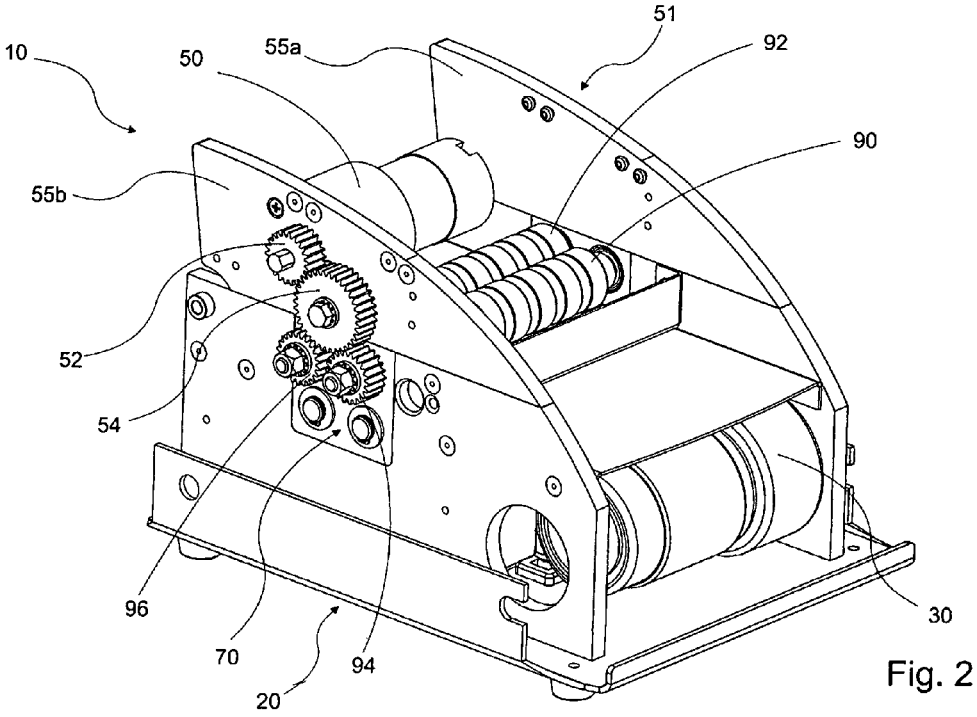

As shown in FIGS. 1 and 2, the movable upper portion 51 is hinged on the base 20 by means of pins 53. The upper portion 51 comprises two walls 55A,55B between which a second electric motor 50 coupled to a first toothed wheel 52 is mounted and which meshes with a second toothed wheel 54.

The electric motor 50 and the toothed wheels 52,54 form a second motorization for rotating the drawing rolls of the roll unit 70, which will be described below.

Figure 4:
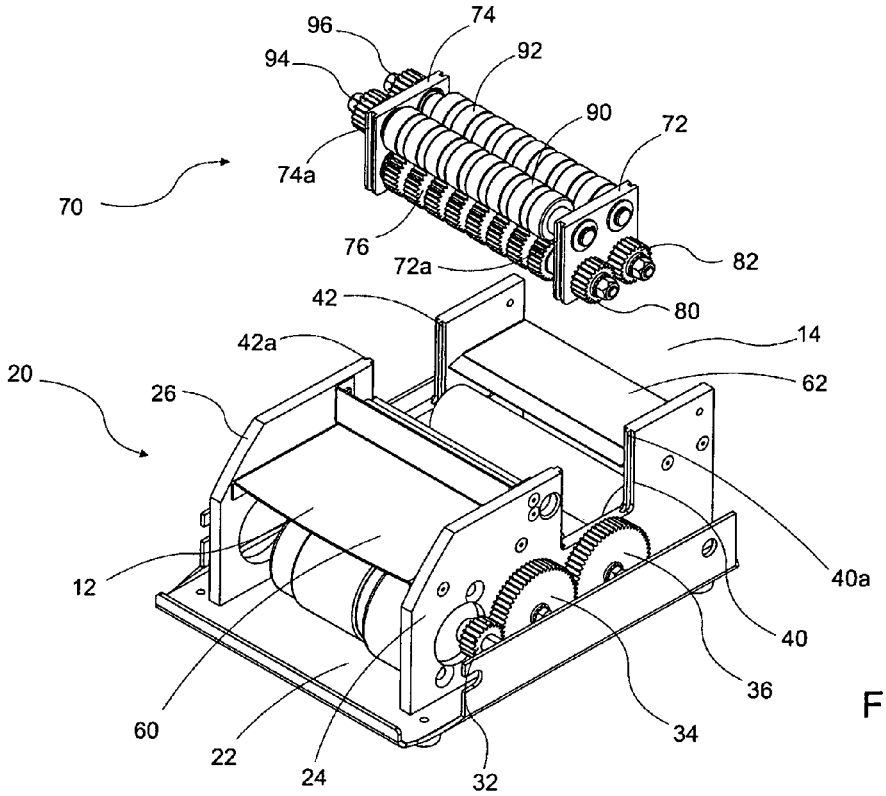
FIG. 4 is a perspective view of the base and the roll unit of the device of FIGS. 1 and 2.

From FIG. 4, we see that two rectangular recesses 40, 42 are made in the base 20 respectively at the top centre part of the two vertical plates 24,26, which allow the roll unit 70 to be inserted into the base 20.

A longitudinal projection is made along two parallel and opposite vertical edges of the rectangular recesses 40,42 whose purpose is explained below.

Figure 5:
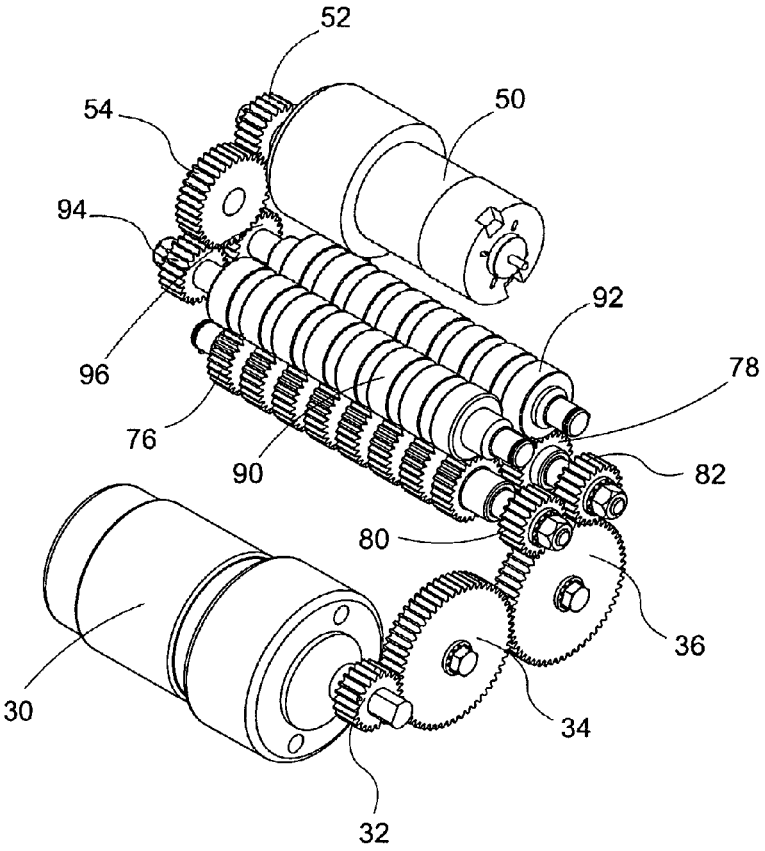
FIG. 5 is a perspective view of the inside components of the device of FIGS. 1 and 2.
Figure 6:
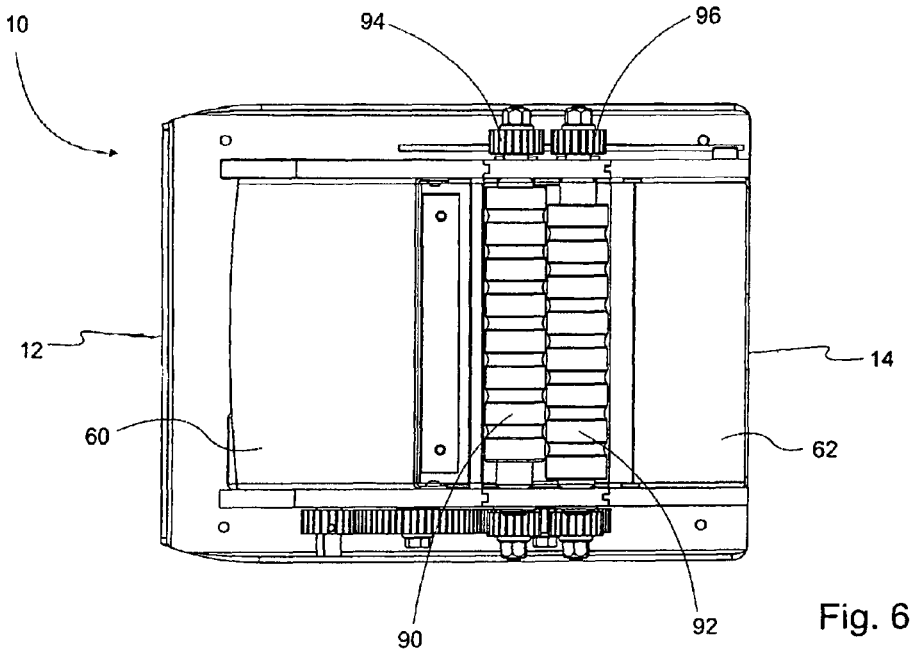
FIG. 6 is a top view of the device of FIG. 1.

As shown in FIGS. 4 and 5, the roll unit 70 comprises a first and a second support 72,74 spaced apart between them. The two supports have sizes corresponding to those of the two recesses 40,42 made in the base 20.

Two scraping rolls 76,78 of the protective film which covers the scratch tickets are rotatably mounted at the their respective ends on the lower part of the two supports 72,74 and arranged parallel to each other. Each scraping roll 76,78 is coupled to a respective pinion 80,82 mounted on the outside of the first support 72 and which mesh both with the third toothed wheel 36 of the first motorization when the roll unit 70 is inserted into the base 20.

Two drawing rolls 90,92 of the ticket are rotatably mounted at their respective ends on the upper part of the two supports 72,74 and arranged parallel to each other and opposite to the two scraping rolls 76,78. The drawing rolls 90,92 are spaced apart from the scraping rolls 76,78 to an extent so as to allow the passage of the ticket between them and, at the same time, to allow the drawing rolls 90,92 to draw the ticket, so that the scraping rolls 76,78, by pressing against the respective drawing rolls 90,92, can remove the film which covers the tickets.

Each drawing roll 90,92 is coupled to a respective pinion 94,96 mounted on the outside of the second support 74 which both mesh with the second toothed wheel 54 of the second motorization when the roll unit 70 is inserted into the base 20 and the upper portion 51 placed on the base 20.

Two grooves 72*a*, 74*a*, having a corresponding profile to that of the longitudinal projections 40*a*, 42*a* made on the edges of the recesses 40,42 of the base 20, are made along two parallel and opposite vertical edges of the two supports 72,74.

To insert the roll unit 70 into the base 20, it is then sufficient to raise the movable upper portion 51 with respect to the base 20, insert the two supports 72,74 into the corresponding recesses 40,42 of the base 20 by sliding the longitudinal projections 40*a*, 42*a* of the edges of the recesses 40,42 inside the grooves 72*a*, 74*b* of the edges of the supports 72,74 and, finally, lower the movable upper portion 51 until it just rests on the base 20.

A first and a second support plate 60,62 of the ticket are respectively positioned on the entry side 12 and on the exit side 14 of the base 20 for the ticket.

For the operation of the device, it is sufficient to insert the roll unit 70 into the base 20 as explained above, to start both the electric motor 30 for the motorization of the scraping rolls and the electric motor 50 for the motorization of the drawing rolls.

At this point, it is sufficient to insert the ticket to be scratched on the entry side 12 positioning it on the first support plate 60 and wait until the ticket comes out from the opposite side 14 completely scratched resting on the second support plate 62.

In this way, in case of jamming of the device 10, it is sufficient to raise the movable upper portion 51, to grasp and lift the roll unit 70 so as to disengage the supports 72,74 from the corresponding recesses 40,42 of the base 20, remove the cause of the jamming and carry out the previous operations reversely in order to reassemble the roll unit 70 into the base 20.

Even the maintenance and cleaning operation of the device 10 occurs simply and quickly operating as described above, namely by removing the roll unit 70.

Furthermore, in case of breakage of the rolls, which form the most critical part of the device, the repair is very simple and even immediate if a substitutive roll unit is available.

So the device 10 can have two positions: one operative position of working where the roll unit 70 is inserted into the base 20 and an inoperative or maintenance position where the roll unit 70 is completely separated from the base 20.

Figure 7:
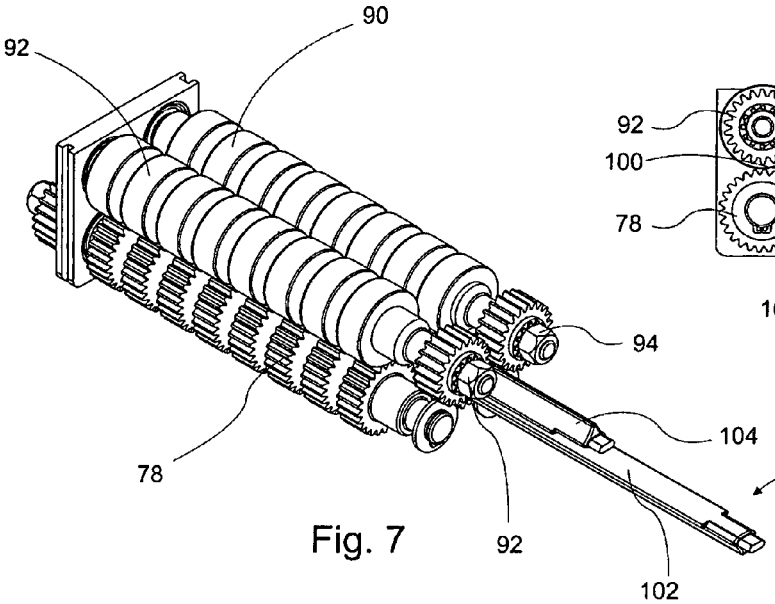
FIGS. 7 and 8 are respectively a perspective view and a side view of the roll unit showing an element used to prevent the jamming of the sheet to be scratched.
Figure 8:
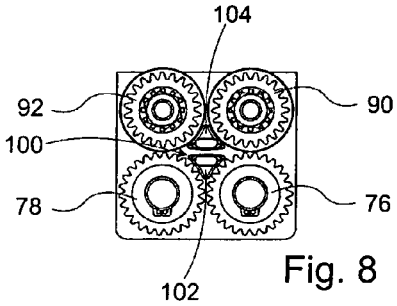

FIGS. 7 and 8 show a roll unit provided with an anti jamming element 100 of the sheet to be scratched.

The anti jamming element 100 comprises a first bar 102 with a triangular section which extends along the entire length of the scraping rolls 76,78 and it is positioned between these two rolls so as to create a continuous passage of the sheet so that the end of the sheet can go straight through preventing it from accidentally sliding between the two scraping rolls 76,78.

Similarly, the anti jamming element 100 comprises a second bar 104 with a triangular section which extends for the entire length of the drawing rolls 90,92 and it is positioned between these two rolls so as to create a continuous passage of the sheet so that the end of the sheet can go straight through preventing it from accidentally sliding between the two rolls 90,92.

It is evident that any change which is conceptually or functionally equivalent falls under the scope of the present invention.

For example, the roll unit 70 may also be connected to the base 20 by means of a hinge so that the roll unit 70 is hinged to the base 20, while still allowing a quick reactivation of the functionality of the device 10 in case of jamming or a fast maintenance and/or cleaning operation.

In practice, the interchangeable roll unit 70 is always mobile, namely it is movable and therefore can simply be moved with respect to the base 20, or removable and thus can be completely removed from the base 20.

Moreover, it is also possible to eliminate the movable upper portion 51 providing that the motorization of the scraping rolls 76,78, i.e. the motor 50 and toothed wheels 52 and 54, is mounted on the base 20.

The invention claimed is:

1. A device for removing a protective film off a sheet such as tickets, comprising at least one scraping roll, configured to remove said protective film;

at least one drawing roll, configured to draw said sheet, the at least one drawing roll in a location opposite said at least one scraping roll, the at least one scraping roll and the at least one drawing roll having parallel non-coaxial longitudinal axis, and between which rolls said sheet passes;

a base, a roll unit including said at least one scraping roll and said at least one drawing roll, said roll unit being mobile or removable with respect to said base and able to take at least two positions, a first operative position wherein said roll unit is inserted or mounted in said base and a second inoperative position wherein said roll unit is displaced or removed from said base;

a constraint means between said base and said roll unit, wherein said roll unit comprises a first support and a second support spaced apart from each other and between which said at least one scraping roll and said at least one drawing roll extend, said constraint means has a guiding profile made in said first and second support and two recesses made in said base and having profiles corresponding to the guiding profiles of said first and second support, so that said first and second support may be inserted in said recesses of the base, thus making the roll unit removable with respect to said base.

2. The device according to claim 1, wherein in said roll unit said at least one scraping roll are two in number and said at least one drawing roll are two in number, thereby allowing drawing of a first surface of the sheet by the at least one drawing roll while scraping of a second surface of the sheet by the at least one scraping roll, the second surface being a non adjacent surface to the first surface.

3. The device according to claim 2, wherein said roll unit is provided with an anti jamming element positioned between said two scraping rolls and said two drawing rolls so as to create a continuous passage of the sheet so that an end of the sheet may proceed straight through preventing the sheet from sliding between said two scraping rolls or between said two drawing rolls.

4. The device according to claim 1, wherein said base comprises motor means of said at least one scraping roll.

5. The device according to claim 4, wherein said motor means of said at least one scraping roll comprises at least one toothed wheel and said at least one scraping roll comprises at least one pinion meshing with said at least one toothed wheel of said motor means of said at least one scraping roll when said roll unit is mounted or inserted in said base in the operative position so that said at least one scraping roll is moved by said motor means.

6. The device according to claim 1, further comprising a movable upper portion with respect to said base, said movable upper portion including motor means of said at least one drawing roll.

7. The device according to claims 6, wherein said motor means of said drawing roll comprise at least one toothed wheel and said at least one drawing roll comprises at least one pinion meshing with said at least one toothed wheel of said motor means of said at least one scraping roll when said roll unit is mounted or inserted in said base in the operative position so that said at least one drawing roll is moved by said motor means.

* * * * *